US007507923B2

(12) United States Patent
Azizi et al.

(10) Patent No.: US 7,507,923 B2
(45) Date of Patent: Mar. 24, 2009

(54) ELECTRICAL SWITCH

(75) Inventors: Farzad Azizi, Mississauga (CA); Christopher Larsen, Mississauga (CA); Darren Rest, Mississauga (CA)

(73) Assignee: Omron Dualtec Automotive Electronics Inc., Oakville (CA)

( * ) Notice: Subject to any disclaimer, the term of this patent is extended or adjusted under 35 U.S.C. 154(b) by 0 days.

(21) Appl. No.: 11/566,069

(22) Filed: Dec. 1, 2006

(65) Prior Publication Data

US 2008/0017491 A1 Jan. 24, 2008

Related U.S. Application Data

(60) Provisional application No. 60/741,872, filed on Dec. 5, 2005.

(51) Int. Cl.
*H01H 9/02* (2006.01)

(52) U.S. Cl. ..... 200/295; 200/512

(58) Field of Classification Search ..... 200/295, 200/310–314, 341–345, 5 R, 5 A, 512–517, 200/1 B, 400
See application file for complete search history.

(56) References Cited

U.S. PATENT DOCUMENTS 3,600,528 A 8/1971 Leposavic
3,789,167 A 1/1974 Seeger, Jr. et al.
3,829,632 A 8/1974 Klehm, Jr.
3,911,234 A 10/1975 Kotaka
4,145,584 A 3/1979 Otterlei
4,345,119 A 8/1982 Latasiewicz
4,375,018 A 2/1983 Petersen
4,408,103 A * 10/1983 Smith, III ..... 206/6 A
4,423,294 A 12/1983 Walser et al.
4,469,330 A * 9/1984 Asher ..... 463/38
4,638,131 A 1/1987 Kidd et al.
4,845,323 A 7/1989 Beggs
4,916,275 A 4/1990 Almond
5,120,912 A 6/1992 Sharp
5,130,506 A 7/1992 Zuercher et al.
5,349,881 A * 9/1994 Olorenshaw et al. ... 74/471 XY
5,426,275 A 6/1995 Maeda et al.
5,430,261 A 7/1995 Malone
5,468,924 A * 11/1995 Naitou et al. ..... 200/6 A
5,555,004 A * 9/1996 Ono et al. ..... 345/161
5,559,311 A 9/1996 Gorbatoff
5,693,920 A 12/1997 Maeda
5,719,361 A 2/1998 Lee (Continued)

*Primary Examiner*—Michael A Friedhofer
*Assistant Examiner*—Lisa N Klaus
(74) *Attorney, Agent, or Firm*—Brett J. Slaney; John R. S. Orange; Blake, Cassels & Graydon LLP

(57) ABSTRACT

A low profile switch assembly is provided having a base portion that supports a folded flexible circuit sealed about its edges, an overlying deformable elastomeric portion, and a pair of window knobs. The base portion has a pair of integrally formed, upwardly extending posts that pivotally support the window knobs and encourage alignment of the flexible circuit and the overlying elastomeric pad. A series of domes are formed in the elastomeric pad, pairs of which are operated sequentially by the window knob acting on a lever bridging the pairs of domes. The domes, when collapsed, compress portions of the flexible circuit to bridge opposing traces within the folded circuit to actuate respective switches. The arrangement of the components provides a low profile device that inhibits contamination and uses fewer parts.

22 Claims, 5 Drawing Sheets

U.S. PATENT DOCUMENTS 5,734,136 A 3/1998 Newcomer et al.
5,743,386 A * 4/1998 Liao ..... 200/512
5,753,874 A 5/1998 Kossakowski
5,834,716 A 11/1998 Lee
5,947,750 A 9/1999 Alcoe et al.
6,027,267 A 2/2000 Yokobori
6,239,392 B1 5/2001 Serizawa et al.
6,274,826 B1 * 8/2001 Serizawa et al. ..... 200/5 R
6,737,592 B1 5/2004 Hoang et al.
6,750,406 B2 * 6/2004 Komatsu et al. ..... 200/1 B
6,809,272 B2 10/2004 Yamada
6,835,071 B2 12/2004 Pupkiewicz et al.
6,906,273 B2 6/2005 Searle et al.
6,914,201 B2 * 7/2005 Van Vooren et al. ..... 200/1 B
6,914,202 B2 7/2005 Sugimoto et al.
6,927,344 B1 * 8/2005 Gall et al. ..... 174/254
6,933,925 B1 8/2005 Gibbons et al.
7,075,794 B2 * 7/2006 Gall et al. ..... 361/749
7,109,428 B2 * 9/2006 Galvin et al. ..... 200/5 R
2005/0056457 A1 * 3/2005 Gall et al. ..... 174/254

* cited by examiner

ELECTRICAL SWITCH

This application claims priority from U.S. Provisional Patent Application No. 60/741,872 filed Dec. 5, 2005.

FIELD OF THE INVENTION

The present invention relates to electrical switches, and more particularly to multi-stage electrical switches.

DESCRIPTION OF THE PRIOR ART

Electrical switches are used for controlling electrical circuits. Many electrical switches are constructed from a combination of mechanical and electrical components. Such switches translate user input to an electrical control signal. For example, a light switch having an external toggle enables a user to selectively open and close a circuit for turning "on" and "off" a light.

In automotive applications, electrical switches are often used for controlling electro-mechanical systems such as power windows that open and close automobile door windows. These window switches may often be integrated into a console or door frame along with other electrical switches, e.g. power door locks. As the number of electrically controlled components in an automobile increases, the space available for housing these components can become limited.

Electrical components used in an automobile are also prone to contamination due to the nature of activities that may occur during operation of the automobile. For example, a beverage that is spilled while driving may contaminate electrical switches and their accompanying circuitry. Therefore, the arrangement of the components in the switches need be considered, as well as their placement within the vehicle.

In addition to their inherent increased space requirement in the console of the vehicle, larger and more extensive switches require additional material, such as plastic, for certain components, as well as larger or more complicated circuit boards, which can increase cost. For example, circuit boards containing fibreglass, e.g. printed circuit boards (PCB), can increase the cost of a component, due to a relative increase in the cost of the fibreglass used to construct the PCB.

Accordingly, cost, reliability and size are important considerations when implementing electrical switches for operating electro-mechanical systems in an automobile.

Various prior art window switches teach specific arrangements for implementing switches in an automobile. In particular, such prior art switches teach multi-functional switches using a single toggle or "window knob". A single window switch may be used to provide dual-stage operation in both forward and rearward directions. The common application for such switches is to provide manual and automatic window operation for opening and closing same, wherein the application of a first force operates the window switch in a manual mode, and the application of a second force, being greater than the first force, operates the window switch in an automatic mode. Typically by applying the second force, the window continues to open without further tilting of the window knob. Generally, these window switches offer tactile feedback to the user enabling the user to discern between the manual mode and the automatic mode.

Examples of the above type of prior art switches are shown in U.S. Pat. No. 6,737,592 to Hoang et al., published on May 18, 2004; U.S. Pat. No. 6,914,202 to Sugimoto et al., published on Jul. 5, 2005; and U.S. Pat. No. 5,719,361 to Lee, published on Feb. 17, 1998.

The arrangements taught in these prior art examples utilize a relatively high profile, therefore requiring a greater amount of space in the console of the vehicle, and a greater amount of material to construct the components. In particular, Lee uses a large shroud for supporting the window knob, with a separate base to support the various other components. Sugimoto has a relatively high profile pusher that is supported by an equally high profile housing. Hoang also has a high profile support for accommodating slidable paddles for operating on the underlying switch circuitry. Clearly, these arrangements do not provide a simple or compact device, and would generally require a greater amount of space in an automobile console, as well as an increased amount of material.

Moreover, none of the above prior art examples offer an arrangement that is suitable for inhibiting contamination. Sugimoto in particular uses many moving parts that could become stuck together if a tacky contaminate such as a soft drink seeped into the switch. Moreover, the arrangement taught by Lee would enable contaminates to seep between layers once the contaminates enter beneath the shroud. In fact, a tacky substance may cause the layers to stick together whilst covering critical contact areas or create an unwanted separation between the layers. Furthermore, it would be a somewhat complicated task to disassemble the switch in order to remove or clean away contaminates, and due to such a burden of labour, the switch may possibly be replaced in its entirety, which does not exhibit reliability of the component.

There exists a need for an electrical switch that can address at least one of the above-described problems, namely one that reduces one or more of cost, size, and the potential for contamination.

It is therefore an object of the present invention to provide an electrical switch that obviates or mitigates at least one of the above-mentioned disadvantages.

SUMMARY OF THE INVENTION

In one aspect, a switch assembly comprising a base portion having at least one integrally formed post extending upwardly therefrom. The post pivotally supports an actuator member, and the base portion supports a flexible circuit portion interposed between the base portion and an elastomeric portion. The elastomeric portion has at least one collapsible dome formed therein, wherein the actuator member interacts with the at least one dome upon pivotal movement thereof to collapse the dome and compress the circuit portion to actuate a switch thereof.

BRIEF DESCRIPTION OF THE DRAWINGS

An embodiment of the invention will now be described by way of example only with reference to the appended drawings wherein:

FIGS. 4(*b*) and 4(*c*) show sequential operational views of the portion shown in FIG. 4(*a*);

DETAILED DESCRIPTION OF THE INVENTION

Figure 1:
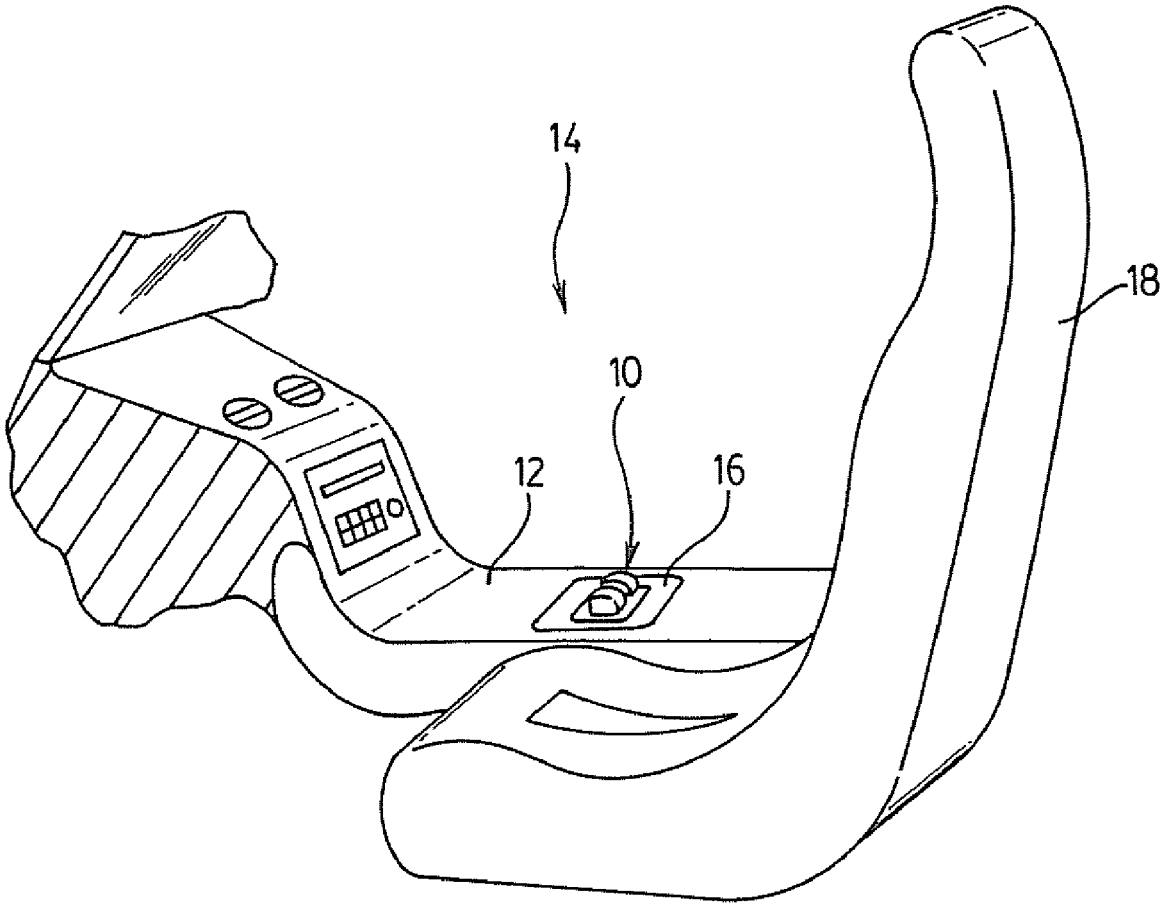
FIG. 1 is a partial perspective view of the interior of an automobile.

Referring therefore to FIG. 1, a switch assembly is generally denoted by numeral 10. In the exemplary environment shown in FIG. 1, the switch assembly 10 is used for powering door windows (doors and windows not shown) in an automobile 14, and is installed in a central console 12, between a pair of seats 18 (only one shown). The switch assembly 10 is supported in the console 12 with a panel 16.

Figure 2:
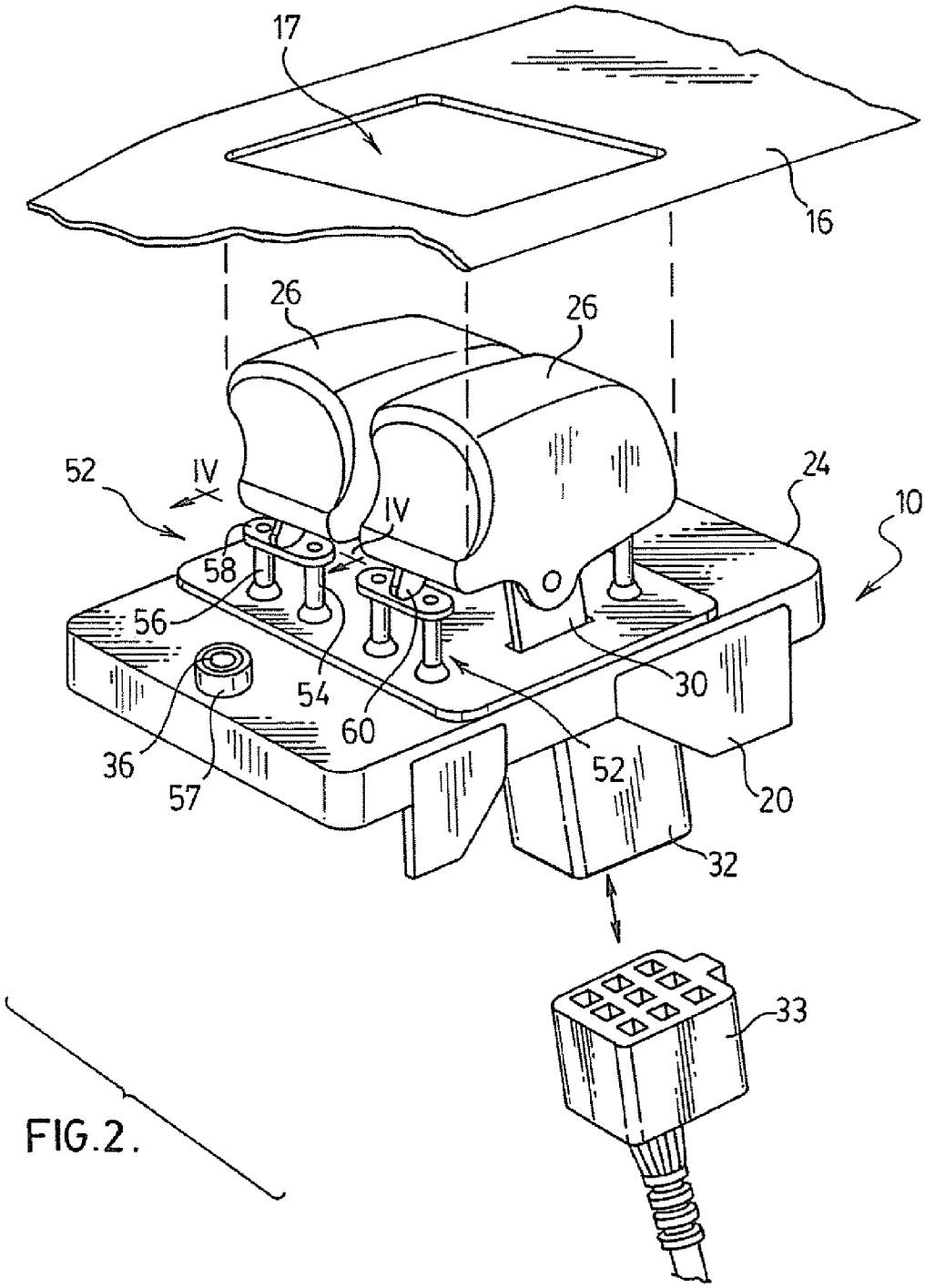
FIG. 2 is a perspective view of an embodiment of a window switch shown in FIG. 1, in situ.
Figure 3:
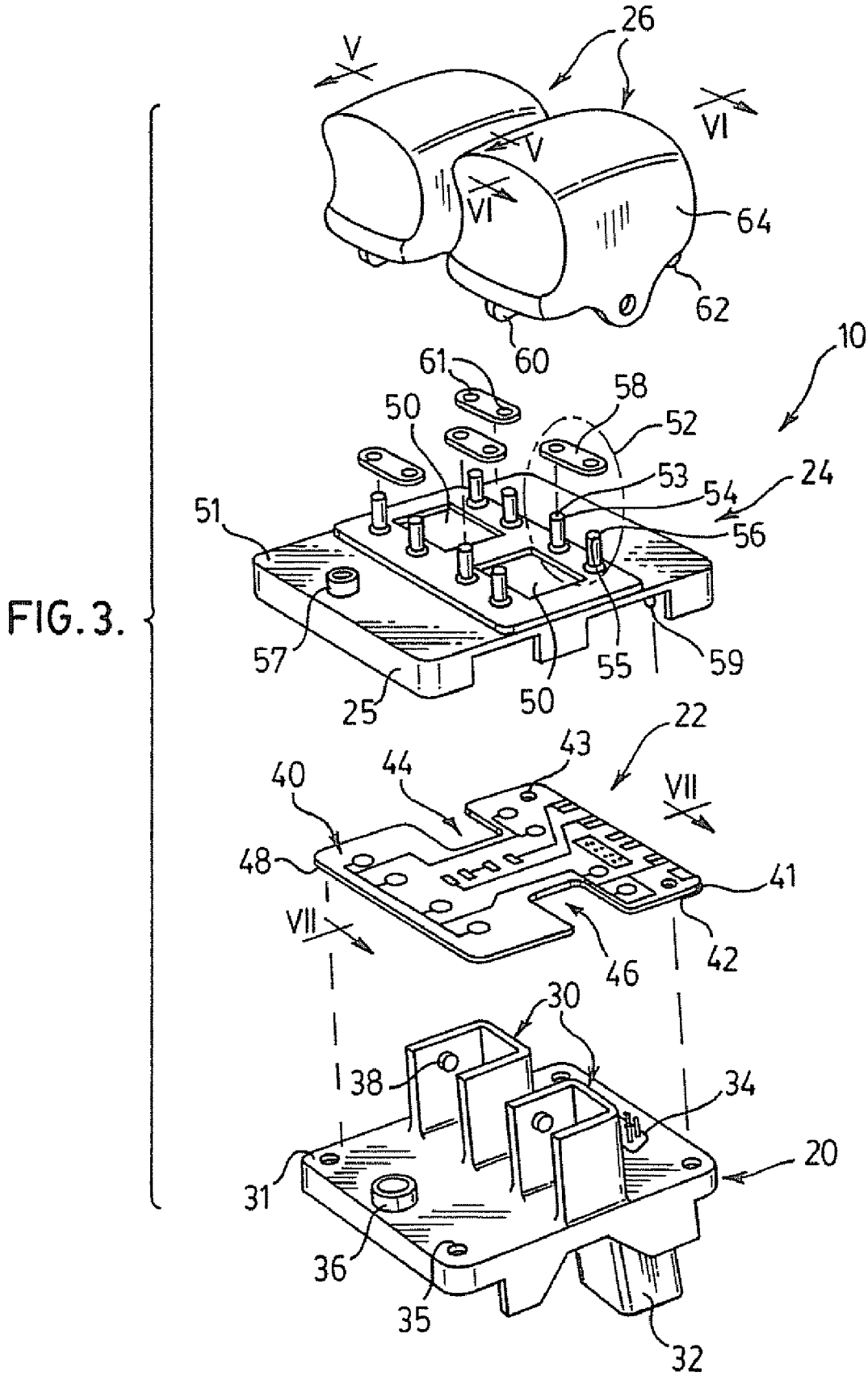
FIG. 3 is an exploded view of the components of the window switch shown in FIG. 2.

The switch assembly 10 is shown in FIGS. 2 and 3 in assembled and exploded views respectively. In the figures, equivalent components are given equivalent reference numerals. The switch assembly 10 includes a base portion 20 that supports a folded flexible circuit 22, an overlying deformable elastomeric portion 24, and a pair of actuation buttons, in this example, window knobs 26.

The base portion 20 has a pair of upwardly extending posts 30, each of which is generally "C-shaped" and has a pair of inwardly protruding flanges 38. The posts 30 are integrally formed with and extend from a generally planar stage 31. A downwardly projecting female connector 32 is formed on the underside of the base portion 20. The connector 32 has a series of pins 34 that extend through the stage 31 at their one end, and mate with a corresponding male connector 33 at their other end. The connectors 32 and 33 may be any suitable electrical connector, and are preferably standard automotive electrical connectors. The base portion 20 also has a series of mounting holes 35 and an alignment post 36 for aligning the elastomeric portion 24 thereon. It will be appreciated that the base portion 20 may also incorporate other features, such as channels for accommodating a light pipe (not shown) and shall not be restricted to the arrangement shown in FIGS. 2 and 3.

Figure 7:
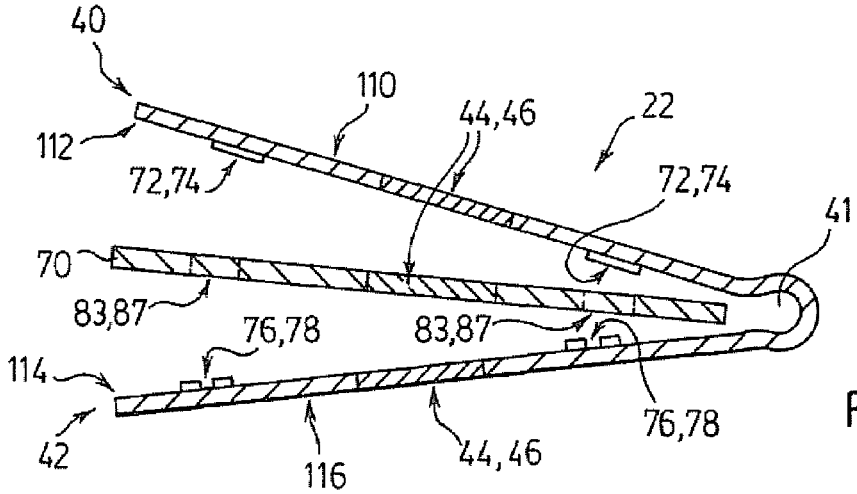
FIG. 7 is a sectional view of the folded flexible circuit shown in FIG. 3 along the line VII-VII.

The flexible circuit 22 shown in FIGS. 3 and 7, is a unitary flex-circuit board that is folded over itself along edge 41 to define an upper circuit layer 40 and a lower circuit layer 42. The layers 40 and 42 are preferably sealed about their edges to create a sealed edge 48. Sealing the edges of the layers 40 and 42 protects the circuitry within the folded flex-circuit, the features of which will be explained later. The flexible circuit 22 has a pair of channels 44 and 46 formed therein to accommodate passage of the posts 30 therethrough whilst the flexible circuit 22 is supported on the stage 31. In the example shown in FIG. 3, the circuit 22 has a pair of holes 43 that align with two of the holes 35 on the stage 31. When positioned, the end of the circuit 22 opposite the folded edge 41 terminates prior to the other two of the holes 35 and the alignment post 36. The planar stage 31 provides a stable support for the flexible circuit 22.

The flexible circuit 22 includes an inner layer 70 which is sandwiched between the upper layer 40 and lower layer 42, within the edge 48, of the flexible circuit 22. The inner layer 70 has a first aperture 83 and a second aperture 87 that enable the upper layer 40 to interact with the lower layer 42 through compression of the flexible circuit 22 in the region of the apertures 83 and 87. Further detail of the flexible circuit 22 is shown in FIG. 7.

Figure 4A:
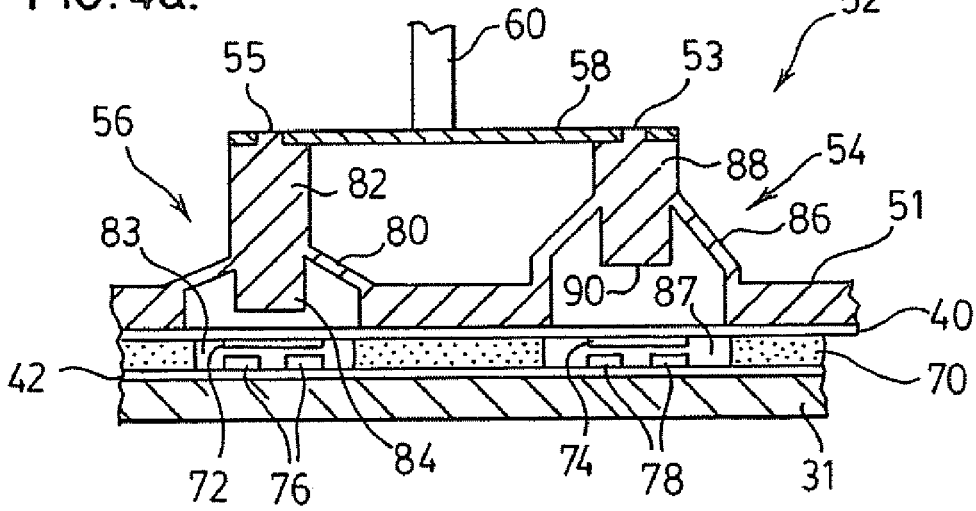
FIG. 4(*a*) is a sectional view of a portion of the window switch shown in FIG. 2 along the line IV-IV.
Figure 4B:
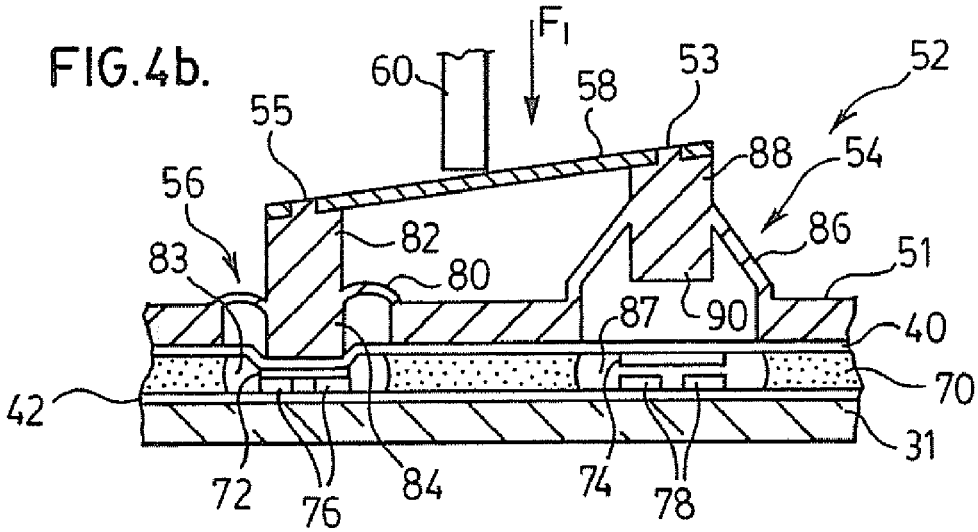
Figure 4C:
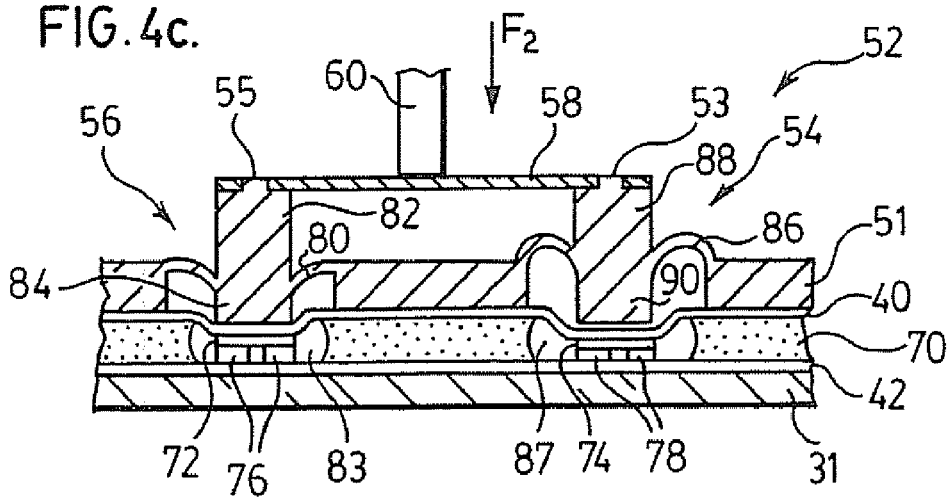

The upper layer 40 has a first upper contact 72 secured to its inwardly directed surface 112 positioned in alignment with the first aperture 83, and a second upper contact 74 secured to its inwardly directed surface 112 positioned in alignment with the second aperture 87. The lower layer 42 has a first set of spaced apart contacts 76 secured to its inwardly directed surface 114 positioned in alignment with the first aperture 83, and a second set of spaced apart contacts 78 secured to its inwardly directed surface 114 positioned in alignment with the second aperture 87. As shown in FIG. 4(*a*), the inner layer 70 maintains a spaced apart relationship between the contact 72 and the contacts 76, and the contact 74 and the contacts 78.

The elastomeric portion 24 is a unitarily formed piece that includes a skirt 25 extending from a generally planar pad 51 to cover the edges of the stage 31 of the base portion 20, as shown in FIG. 2. The pad 51 includes a series of downwardly extending nubs 59 that are sized to snugly fit into the holes 35, and a collar 57 that is sized to snugly fit around the alignment post 36. A pair of windows 50 are formed in the pad 51, and are sized to allow passage of the posts 30 therethrough. The elastomeric portion 24 includes actuators 52 that cooperate with the circuit 22 to control movement of the window. In the example shown in FIG. 3, the pad 51 has four sets of actuators 52. In this example, a pair of actuators 52 are aligned to interact with a respective one of the window knobs 26. As is best seen in FIG. 4, each actuator 52 includes a first collapsible dome 56 having a nub 53, a second collapsible dome 54 having a nub 55, and a lever 58 that bridges the domes 54 and 56. The domes 54 and 56 are unitarily formed in the pad 51, and the lever 58 comprises a separate component that is preferably formed from a rigid piece of metal. The lever 58 has a pair of holes 61 that are sized to snugly fit on the nubs 53 and 55.

The first dome 56 includes an integrally formed neck 82, collapsible annular ring 80, and an interior downwardly extending protrusion 84 that is positioned in alignment with the first aperture 83 of the flexible circuit 22. Similarly, the second dome 54 includes an integrally formed neck 88, collapsible annular ring 86, and an interior downwardly extending protrusion 90. The domes 56 and 54 are differently shaped. In this embodiment, the neck 82 is longer than the neck 88, and the ring 80 is shorter than the ring 86. The protrusions 84 and 90 are similar in dimension. Consequently, the distal end of the protrusion 84 is closer to the outer surface 110 of the upper layer 40 than the protrusion 90.

Figure 5:
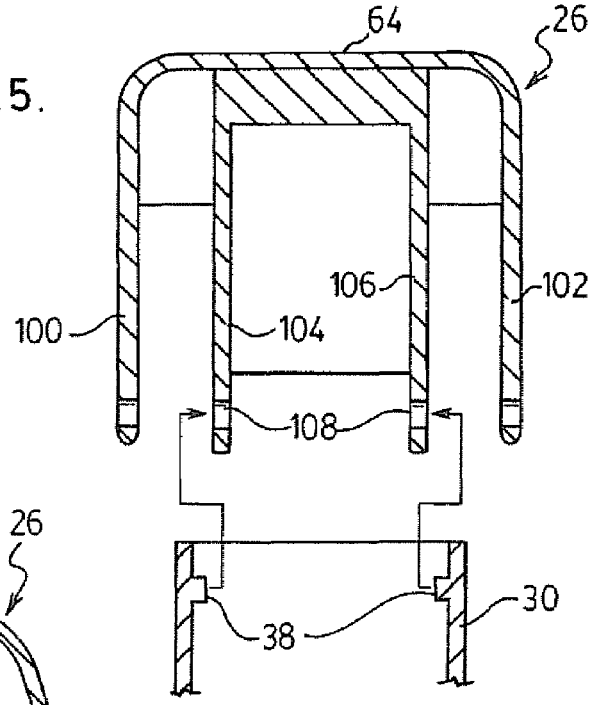
FIG. 5 is a sectional view of a window knob shown in FIG. 3 along the line V-V.
Figure 6:
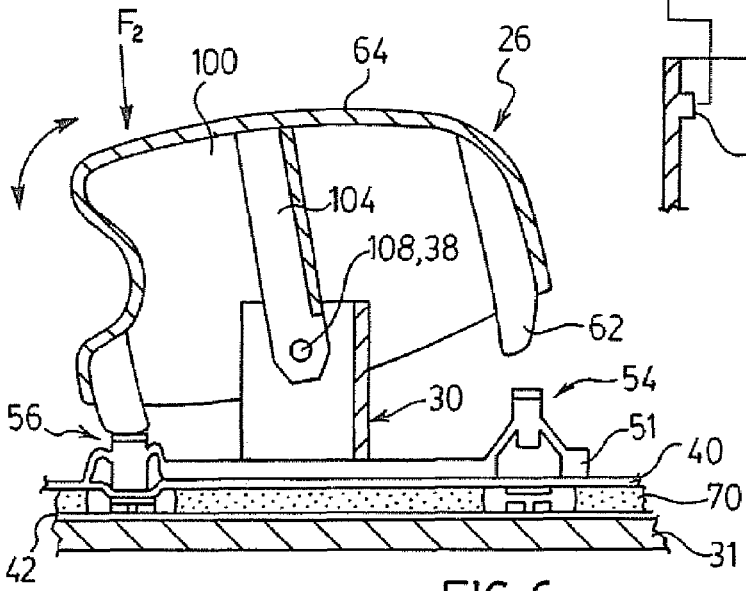
FIG. 6 is a sectional view of the switch shown in FIG. 3 along the line VI-VI.

The actuators 52 are controlled by the window knob 26 shown in FIGS. 5 and 6. The window knob 26 is preferably a plastic component having an ergonomically formed shell 64 that enables a user to tilt the knob 26 in the fore and aft directions. A forward protrusion 60 and a rearward protrusion 62 extend from beneath the shell 64. The knobs 26 are pivotally supported by respective posts 30 as explained below.

The protrusion 60 interacts with the lever 58 at a point that is closer to the first dome 56 than the second dome 54 to create an offset fulcrum. Consequently, a force transferred from the protrusion 60 to the lever 58 will cause the first dome 56 to collapse before the second dome 54, in a sequential manner as will be described in more detail later.

The window knob 26 is shown in greater detail in the sectional view of FIGS. 5 and 6. As best shown in FIG. 5, the shell 64 has a pair of sidewalls 100 and 102, and a pair of inner support walls 104 and 106. Each support wall 104, 106 has an attachment hole 108. The holes 108 are sized to receive the inwardly facing flanges 38 of the posts 30 to enable pivotal attachment of the window knob 26 to the base 20. Consequently, the window knob 26 will pivot about an axis defined by respective pairs of the flanges 38 when tilted by a user, in either the fore or aft directions. Although the sectional view of FIG. 4(*a*) illustrates only the interaction of the forward protrusion 60 with the lever 58, it will be appreciated that the rearward protrusion 62 interacts with another of the levers 58 in a similar manner, through a rearward tilting movement of the window knob 26.

The components shown in FIG. 3 are assembled as shown in FIG. 2 by first aligning the channels 44 and 46 of the circuit 22 with the posts 30 of the base, and sliding the flexible circuit 22 over the posts 30 until it is aligned and stably supported by the stage 31. The holes 43 should align with two of the holes 35 and typically, the pins 34 will extend through or interact with the circuit 22 such that they can be soldered or otherwise connected thereto for permanent assembly of the switch 10. Accordingly, the flexible circuit 22 may transmit and receive electrical signals through the connector 32 once assembled with the base 20. Once assembled, the circuit 22 should lie flat on the stage 31 and be stably supported thereby.

The windows 50 of the elastomeric portion 24 may then slide over the posts 30, and the pad 51 will cover the circuit 22 while the skirt 25 extends over the stage 31. The pad 51 is aligned and secured to the base 20 through fitment of the nubs 59 within the holes 35, and the collar 57 over the alignment post 36. Once the elastomeric portion 24 is securely positioned, the pad 51 should lie substantially flat on the circuit 22. Such arrangement aligns the domes 54 and 56 with the apertures 83 and 87 respectively.

The levers 58 may then be supported on the domes 56 and 54 through fitment of the nubs 53 and 55 with respective ones of the holes 61. It will be appreciated that the levers 58 may be assembled with the elastomeric portion 24 in advance of assembling the switch assembly 10, and that the above assembly procedure is provided for illustrative purposes only. The window knobs 26 may then be attached to the posts 30 for pivotal movement thereon.

The assembly 10 shown in FIG. 2 results in a series of layers that interact to operate the actuators 52. Such layering is shown in the sectional view of FIG. 4(*a*). As can be seen in the figure, when assembled, the stage 31 provides a flat, stable support for the flexible circuit 22.

As most apparent in FIG. 2, the integrally formed posts 30 and stage 31 provide pivotal support for the window knobs 26 and stable support for the flexible circuit 22 and the elastomeric portion 24 whilst maintaining a low profile. The posts 30 encourage alignment of the layers, and the stage 31 enables the pad 51 to be secured thereto. The skirt 25 and the sealed edge 48 both inhibit contamination of the flexible circuit 22. The contacts 72-78 are thus protected from their environment prolonging their lifetime, and maintaining reliable operation therethrough.

The operation of the switch assembly is as follows, making reference to FIGS. 4(*a*)-(*c*). In the switch assembly's rest position, the protrusions 84 and 90 lie above the upper surface 110 of the upper layer 40 of the flexible circuit 22, and the forward protrusion 60 rests on the lever 58. As shown in FIG. 4(*b*), forward tilting of the window knob 26 using a first force $F_1$ transfers this force through the protrusion 60 to the lever 58, that, due to the offset fulcrum, first operates on the first dome 56 to collapse the ring 80 and thereby cause the protrusion 84 to engage the upper surface 110 of the upper layer 40. Although the flexible circuit 22, and pad 51 are stably supported by the stage 31, the aperture 83 enables compression of the upper layer 40 in the region of the aperture 83 whereby $F_1$ causes the contact 72 to bridge the spaced apart contacts 76 and close a first circuit path (not shown) of the flexible circuit 22. In this example, the application of $F_1$ provides a first switching stage for manual operation of an automobile window.

FIG. 4(*c*) shows a second switching stage wherein the application of a second force $F_2$ being greater than $F_1$ causes further downward translation of the lever 58 such that the lever 58 next operates sequentially on the second dome 54 to collapse the ring 86 and thereby cause the protrusion 90 to engage the upper surface 110 of the upper layer 40 in the region of the second aperture 87. The application of $F_2$ causes the contact 74 to bridge the spaced apart contacts 78 to close a second circuit path (not shown) of the flexible circuit 22. In this example, the application of $F_2$ provides a second switching stage for automatic operation of the automobile window, which thereafter requires no further operation of the window knob 26 to completely open the window.

Tilting the window knob 26 in the rearward direction will operate a second actuator 52 in a similar manner. It will be appreciated that the assembly 10 shall not be limited to the arrangement shown in FIGS. 2 and 3, and that any number of switches and domes can be implemented depending on the particular application.

It can be seen that the switch assembly 10 provides a low profile device using a minimum number of components. The upwardly extending posts 30 serve to provide support for the window knobs 26 as well as encouraging alignment of the layers provided by the elastomeric portion 24 and the flexible circuit 22. The height of the posts 30 can be constructed to accommodate various dome structures and circuit thicknesses, as well as varying designs of window knobs 26. The overlying skirt 25 of the elastomeric portion 24 and the sealed edge 48 of the flexible circuit 22 encourage the inhibition of contamination, whilst being stably supported by the generally planar stage 31 of the base portion 20 during operation. The elastomeric portion 24 further provides a tactile feedback to the user and offers sequential switching capabilities for applications such as automobile door windows.

Although the invention has been described with reference to certain specific embodiments, various modifications thereof will be apparent to those skilled in the art without departing from the spirit and scope of the invention as outlined in the claims appended hereto.

What is claimed is:

1. A switch assembly comprising a base portion having at least one integrally formed post extending upwardly therefrom, the post for pivotally supporting an actuation button, the base portion supporting a flexible circuit portion interposed between the base portion and an elastomeric portion, the elastomeric portion having at least one callapsible dome formed therein, wherein the button interacts with the at least one dome upon pivotal movement thereof to callapse the dome and compress and operate the flexible circuit portion.

2. A switch assembly according to claim 1 wherein the flexible circuit portion comprises a unitary flexible circuit board folded over itself along an edge.

3. A switch assembly according to claim 2 wherein the flexible circuit portion comprises a pair of opposing contacts for each dome that are engaged upon compression of the flexible circuit portion to close a switch.

4. A switch assembly according to claim 3 wherein the flexible circuit portion comprises an intermediate layer between an upper portion and lower portion of the unitary flexible circuit board, the intermediate layer maintaining a seperation between the opposing contacts prior to the dome compressing the flexible circuit portion.

5. A switch assembly according to claim 4 wherein the intermediate layer comprises an aperture aligned with each pair of opposing contacts.

6. A switch assembly according to claim 2 wherein the unitary flexible circuit portion is sealed about its periphery.

7. A switch assembly according to claim 6 wherein the elastomeric portion includes a downwardly extending skirt covering an edge of the base portion to completely cover the flexible circuit portion.

8. A switch assembly according to claim 1 wherein the flexible circuit portion is shaped such that it surrounds the at least one post and is substantially flat on the base portion.

9. A switch assembly according to claim 1 wherein the flexible circuit portion comprises one or more apertuers for receiving corresponding nubs on the elastomeric portion that are in turn received by corresponding apertures in the base portion.

10. A switch assembly according to claim 1 comprising a first dome and a second dome bridged by a first lever, the fist lever being operated on by the actuation button at a point along its length offset from center such that the first dome engages the flexible circuit portion before the second dome engages the flexible circuit portion to provide a sequential operation of the first and second domes.

11. A switch assembly according to claim 10 wherein the first dome comprises a first downward protrusion that extends towards the flexible circuit portion and the second dome comprises a second downward protrusion that extends towards the flexible circuit portion, the first protrusion being closer to the flexible circuit portion than the second protrusion.

12. A switch assembly according to claim 10 wherein the first and second domes comprise nubs for securing the first lever thereto by inserting the nubs into corresponding apertures on the first lever.

13. A switch assembly according to claim 10 comprising a third dome and a fourth dome bridged by a second lever, the second lever being operated on by the actuation button at a point along its length offset from center such that the third dome engages the flexible circuit portion before the fourth dome engages the flexible circuit portion to provide a sequential operation of the third and fourth domes; wherein the first lever is operated on upon movement of the actuation button in a first direction and the second lever is operated on upon movement of the actuation button in a second direction.

14. A switch assembly according to claim 13 wherein the post extends between the first and second domes and the third and fourth domes.

15. A switch assembly according to 13 a first post extending between the first and second domes and the third and fourth domes, the first post, first dome, second dome, third dome and fourth dome defining a first switching unit, the base portion comprising a second post extending between fifth, sixth, seventh and eighth domes to form a second switching unit.

16. A switch assembly according to claim 15 wherein the flexible circuit portion comprises a unitary flexible circuit board folded over itself along an edge, the flexible circuit portion comprising a pair of opposing contacts for each dome that are engaged upon compression of the flexible circuit portion to close a switch; and an intermediate layer between an upper portion and lower portion of the unitary flexible circuit board, the intermediate layer maintaining a seperation between the opposing contacts prior to the dome compressing the flexible circuit portion; wherein the intermediatiate layer comprises an aperture aligned with each pair of opposing contacts and the unitary flexible circuit portion is sealed about its periphery and wherein the elastomeric portion includes a downwardly extending skirt covering an edge of the base portion to completely cover the flexible circuit portion.

17. A switch assembly according to claim 1 wherein the elastomeric portion includes an aperture for permitting passage of each of the at least one post therethrough.

18. A switch assembly according to claim 1 wherein the elastomeric portion includes a downwardly extending skirt covering an edge of the base portion to completely cover the flexible circuit portion.

19. A switch assembly according to claim 1 wherein the elastomeric portion comprises an aperture for receiving an upwardly extending protrusion on the base portion to align the elastomeric portion with the base portion and flexible circuit portion.

20. A method for assembling a switch comprising:

providing a base portion having at least one integrally formed post extending upwardly therefrom, the post for pivotally supporting an actuation button;

arranging a flexible circuit portion over the base portion such that it lies substantially flat thereon;

arranging an elastomeric portion over the flexible circuit portion, the elastermeric portion having at least one collapsible dome formed therein; and pivotally attaching the actuation button to the post, wherein upon pivotal movement of the actuation button , the actuation button interacts with the at least one dome to collapse the dome and compress and operate the flexible circuit portion.

21. A method according to claim 20 wherein prior to arranging the flexible circuit portion the method comprises folding a unitary flexible circuit board over itself, sealing the flexible circuit board along an edge.

22. A method according to claim 20 wherein arranging the elastomeric portion comprises extending a skirt of the elastomeric portion over an edge of the base portion.

* * * * *